United States Patent [19]

Anderson

[11] 4,106,572

[45] Aug. 15, 1978

[54] PAWL SPRING ASSEMBLY FOR A ROTARY IMPACT MECHANISM

[75] Inventor: J. Edward C. Anderson, Moreland Hills, Ohio

[73] Assignee: Marquette Metal Products Co., Cleveland, Ohio

[21] Appl. No.: 817,830

[22] Filed: Jul. 21, 1977

[51] Int. Cl.[2] ..... B25D 15/00

[52] U.S. Cl. ..... 173/93; 267/160

[58] Field of Search ..... 81/52.3, 60–63, 81/63.1, 63.2; 173/93, 93.5, 93.6, 93.7; 267/160, 164; 339/255 RT, 256 RT, 258 A, 258 RR, 262 R, 262 F, 262 RR

[56] References Cited

U.S. PATENT DOCUMENTS

| | | | |
|---|---|---|---|
| 2,028,441 | 1/1936 | Decker | 173/93.5 X |
| 2,107,568 | 2/1938 | Haist | 81/62 |
| 2,712,256 | 7/1955 | Fish | 81/62 X |
| 2,954,714 | 10/1960 | Swenson | 173/93.5 |
| 3,156,309 | 11/1964 | Swenson | 173/93 |
| 3,413,877 | 12/1968 | Teichmeier | 81/61 X |

FOREIGN PATENT DOCUMENTS

| | | | |
|---|---|---|---|
| 222,876 | 11/1942 | Switzerland | 339/258 A |
| 336,612 | 10/1930 | United Kingdom | 339/262 R |

*Primary Examiner*—Lawrence J. Staab

[57] ABSTRACT

In a rotary impact mechanism which has input, output and inertia members substantially symmetrical and journaled about each other for independent angular movement about a common axis and a pawl and ratchet assembly for interconnecting the input and output members for torque transmission, the pawl spring assembly for biasing the pawl in a direction to engage the ratchet comprises a plurality of spring elements formed into a unitary structure and arranged with respect to the pawl to sequentially engage and load the pawl as the pawl is moved in a direction to disengage from the ratchet.

6 Claims, 6 Drawing Figures

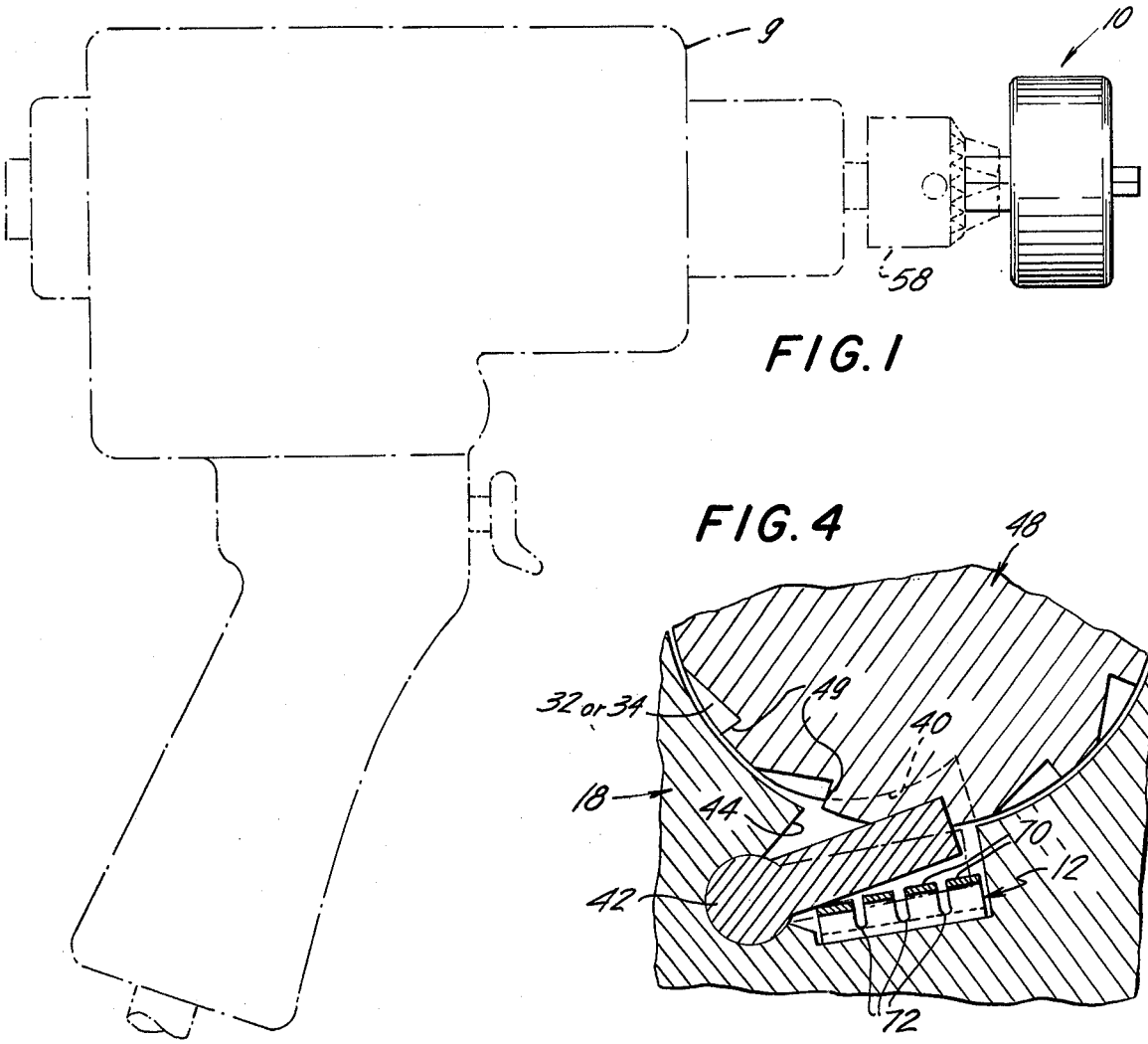
FIG. 1
FIG. 4
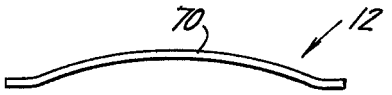
FIG. 5
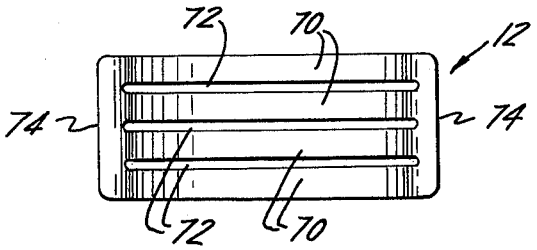
FIG. 6

PAWL SPRING ASSEMBLY FOR A ROTARY IMPACT MECHANISM

This invention relates to rotary impact tools and specifically to rotary impact tools of the type exemplified in the U.S. Pat. to Swenson, No. 3,156,309, dated Nov. 10, 1964.

In impact mechanisms of the type disclosed in the above mentioned patent, for loosening or tightening fasteners, an input, an output and inertia members are arranged in approximate symmetry about a common axis and journaled upon each other at mating, mutually telescoping circular surfaces for independent angular movement about the common axis. A pawl and ratchet assembly is provided for interconnecting the input and inertia members together for torque transmission, the pawl being carried by the inertia member and the ratchet connected to the output member. A power spring means interconnects the input member and inertia member for storing energy upon relative angular movement of the input and inertia members and releasing the stored energy to accelerate angular movement of the inertia member. A cam is provided on the input member which coacts with the pawl upon relative angular movement of the input and inertia members to disengage the pawl from the ratchet and release the pawl for impact engagement with the ratchet to thereby rotatively drive the output member. One or more conical-shaped, spirally-wound, pawl springs are employed to bias the pawl in a direction toward engagement with the ratchet. Thus, as long as the input member is rotated, the escapement and impact-producing re-engagement of the pawls and ratchet occurs as a function of angular movement of input member in over-running or overhauling relation to the output member and inertia member. For each of these escapement and re-engagement motions of the pawls, the pawl springs undergo flexure. It has been found that under rapid rotation of the input member when it is motor-driven, the pawl springs fail, thus rendering the rotary impact mechanism inoperative. The rapid flexure of the pawl springs coupled with the heat generated thereby causes metal fatigue and collapse of the pawl spring. This disadvantage of a relatively short operative life of the pawl springs and, hence, the rotary impact mechanism is overcome by the present invention.

Accordingly, one object of the present invention is to provide a pawl spring assembly for a rotary impact mechanism which can withstand the loads imposed thereon under rapid and numerous flexure cycles and thus have a relatively long operative life.

Another object of this invention is to provide a pawl spring assembly for a rotary impact mechanism which renders a motor-driven impact mechanism commercially feasible by providing it with a relatively long operative life.

A further object of the present invention is to provide a pawl spring assembly which maintains a light load on the pawl in the fully engaged position and which load incrementally increases as the pawl is pivotally moved.

A still further object of this invention is to provide a pawl spring assembly which is easy to install, remove, and replace in a rotary impact mechanism.

SUMMARY OF THE INVENTION

It is, therefore, contemplated that a novel pawl spring assembly be provided which is particularly suitable for a rotary impact mechanism as exemplified in the U.S. Pat. to Swenson, No. 3,156,309 dated Nov. 10, 1964.

The rotary impact mechanism for tightening or loosening a fastener comprises an input member, an output member and an inertia member which are arranged in approximate symmetry about a common axis and journaled upon each other at mating, mutually telescoping circular surfaces for independent angular movement about the common axis. A pawl and ratchet assembly is provided for inter-connecting the input and output members together for torque transmission. The pawl is carried by the inertia member while the ratchet is connected to the output member for conjoined rotation with the latter. A power spring means is attached to inter-connect the input and output members so that the power spring means stores energy upon relative angular movement of the input and inertia members and releases the stored energy to accelerate angular movement of the inertia member. Coacting with the pawl is a cam which upon relative angular movement of the input and inertia members disengages the pawl from the ratchet and releases the pawl for impact engagement with the ratchet to thereby rotatively drive the output member.

The pawl spring assembly comprises a plurality of spring elements arranged to sequentially engage and load the pawl as the pawl is moved by the cam in a direction to disengage from the ratchet.

In a more limited aspect of the invention the spring elements are leaf springs arranged substantially parallel to each other and connected together at opposite adjacent end portions to form a unitary assembly.

It is preferable that the pawl spring assembly be constructed and arranged to impose on the pawl a relatively small biasing force in the fully engaged position to avoid possible chatter between the pawl and ratchet and to insure engagement in all positions of the rotary impact mechanism.

BRIEF DESCRIPTION OF THE DRAWINGS

This invention will be more fully understood from the following description when considered in connection with the accompanying drawing in which:

FIG. 1 is a side elevational view of a rotary impact mechanism having a pawl spring assembly according to this invention and shown attached to a power tool shown in phantom;

FIG. 4 is an enlarged fragmentary cross-sectional view of the pawl and ratchet assembly, somewhat enlarged to better illustrate a pawl spring of this invention;

FIG. 5 is an end elevational view of the pawl spring shown in FIGS. 2 to 4; and FIG. 6 is a plan view of the pawl spring shown in FIG. 5 and on the same scale.

DESCRIPTION OF THE PREFERRED EMBODIMENT

Figure 3:
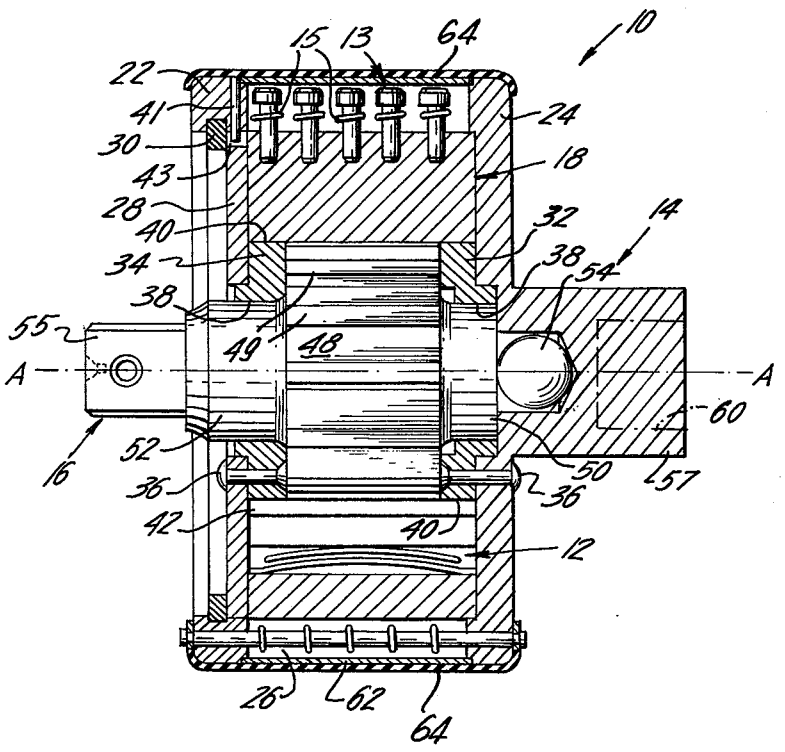
FIG. 3 is a cross-sectional view taken substantially along line 3—3 of FIG. 2.
Figure 2:
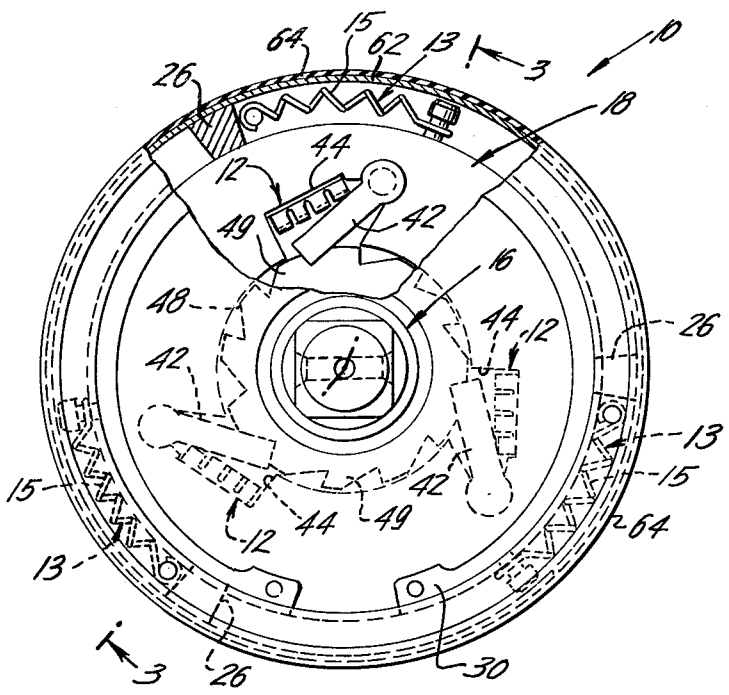
FIG. 2 is an end elevational view of the rotary impact tool shown in FIG. 1 on an enlarged scale and with part broken away for illustration purposes.

Now referring to the drawings and more particularly FIGS. 1 to 3, the reference number 10 generally refers to a rotary impact mechanism of the type shown in the Swenson U.S. Pat. No. 3,156,309, dated Nov. 10, 1964 or as disclosed in applicant's co-pending U.S. Pat. application, Ser. No. 813,072, filed on July 5, 1977, which rotary impact mechanism has pawl spring assemblies 12, according to this invention. This mechanism 10 can be, as shown in phantom in FIG. 1, attached to and driven by a source of continuous rotary power as, for example, an electric, hydraulic or pneumatic motor 9. It is to be understood that while pawl spring assemblies 12 are particularly suited to rotary impact mechanims 10 and solves the short operative life of pawl springs of such mechanisms, it has application to manually actuated impact tools, as exemplified in the U.S. Pat. to Swenson, Nos. 2,954,714 dated Oct. 4, 1960 and 3,108,506 dated Oct. 27, 1963, as well as in other hinged devices where force control is to be achieved in a limited space and consequently fabrication and assembly is difficult.

As best shown in FIGS. 2 and 3, mechanism 10 comprises, in general, a housing or input member 14, an output member 16 and a rotor or inertia member 18 arranged about a common axis A—A and journaled upon each other at mating, mutually telescoping, circular surfaces thereof. A power spring assembly 13 is provided to inter-connect inertia member 18 and input member 14 and to store energy upon relative angular movement between those members and to thereafter release such stored energy to accelerate inertia member 18. The spring assembly 13 may comprise, as shown, plural sets of coil springs 15 or spiral flat springs disclosed in the Swenson U.S. Pat., No. 2,954,714.

The housing or input member 14 has a cylindrical shape with a ring-shaped portion 22 connected to an axially spaced disk-shaped portion 24 by a plurality of circumferentially-spaced, axially extending ribs 26 (See FIGS. 2 and 4). An end plate 28 is secured against axial movement to ring-shaped portion 22 by a snap ring 30. Two cams 32 and 34 are respectively secured by rivets 36 to portion 24 and end plate 28. Each of the cams 32 and 34 are coaxial with axis A—A and have coaxial bores 38 in which is journaled output member 16. As only shown in FIGS. 3 and 4, each cam 32 and 34 has an outer peripheral camming surface 40. Within the annular space defined between input member 14 and output member 16 is disposed rotor or inertia member 18. To insure proper angular orientation of cams 32 and 34 to each other and prevent rotation of plate 28, a pin 41 is mounted on ring portion 22 so as to project radially inwardly and coact with a notch 43 in the peripheral surface of end plate 28, (See FIG. 3).

The inertia member 18 is doughtnut-shaped and coaxially surrounds output member 16 and fits within ribs 26 of input member 14. The inertia member is free to rotatively move relative to the output and input members. The inertia member carries a plurality of circumferentially-spaced pawls 42 (three being shown in the drawings). Each of the pawls 42 is pivotally mounted in a recess 44 in the inner peripheral surface of the inertia member and biased by an associated pawl spring 12 inwardly toward cams 32 and 34 and the ratchet wheel portion 48 of output member 16. The ratchet wheel portion 48 is an enlarged diameter portion having a plurality of circumferentially-arranged teeth 49. The pawls 42 coact with camming surfaces 40 upon relative angular movement of input member 14 and inertia member 18 to pivotally move pawls 42 out of engagement with a tooth of ratchet wheel portion 48 of output member 16 (see FIG. 5) and allow the pawls to engage other teeth 49 of the ratchet wheel portion 48 of the output member.

The output member 16, in addition to ratchet wheel portion 48, has two oppositely extending cylindrical journal portions 50 and 52 which are receivable within bores 38 of cams 32 and 34. While cams 32 and 34 serve as bushings to radially support output member 16, axial thrust is taken up by a ball bearing 54 disposed in a recess 56 in disk-portion 24 and engaging the end surface of journal portion 50 of output member 16. The output member adjacent and integral with journal portion 52 has a substantially square end portion 55 for receiving fastener engaging members, such as detachable socket members (not shown).

Similar to output member 16, input member 14 has an axially extending hub portion 57 which, in cross-section, may have a polygonal shape and adapted to be gripped by the jaws of a check or collect 58 on motor 12, (see FIG. 1). In the alternative, hub portion 56 may be provided with a polygonal-shaped axial recess 60 (shown in dot-dash lines in FIG. 3) into which a mating male member (not shown) is receivable for rotatively connecting input member 14 with a source of rotary power.

A cover 62, in the form of a metal band or strip, is disposed to seat within juxtaposed annular shoulders in the ring and disk portions 22 and 24 of input member 14. The cover 62 is held in place by a seal 64 which is in the form of an annular resilient sleeve and stretched over the cover 62 and the peripheral edges of ring and disk portions 22 and 24 of input member 14. The cover 62 and seal 64 function to retain lubricant within the mechanism and to maintain the mechanism free from contaminants such as dust, dirt and water.

As best shown in FIGS. 4 to 6, each pawl spring assembly 12 comprises a plurality of substantially spaced leaf springs 70 which are disposed to extend substantially parallel to the pivotal axis of pawl 42. While each leaf spring 70 may be separate elements, it is preferred that leaf springs 70 be inter-connected at their opposite adjacent end portions so as to form a single piece or unitary structure. This single piece construction simplifies the positioning and maintenance of the spacing between leaves and, therefore, facilitates the assembly and disassembly of the mechanism. To this end, the pawl spring 12 is constructed of a single, rectangular, thin strip of spring steel, e.g. SAE 1095, scored by a plurality of substantially spaced slots 72 which terminate short of the ends 74 of the strip. The leaves 70 are bowed in the center as best shown in FIG. 5. As is illustrated, three slots 72 may be cut into the strip to form four leaf springs 70. The strip is dimensioned to snuggly fit within recess 44 in inertia member 18 so that the position of the pawl spring 12 is maintained during the operative life of mechanism 10.

As can best be seen in FIG. 4, pawl spring 12 is so dimensioned and positioned with respect to its associated pawl 42 that the left endmost leaf spring 70 as viewed in FIG. 4 is slightly depressed to preload the pawl when in its fully engaged position. Also as can best be seen in FIG. 4, as pawl 42 is pivotally urged out of engagement with a tooth 49 of ratchet 48 by cams 32 and 34, the pawl sequentially depresses successive leaf springs 70 until all are depressed when the pawl is fully disengaged from ratchet 49, (see dot-dash line position in FIG. 4). Thus, with deformation of successive leaf springs 70, the total deflection to provide the desired load on the pawl, in effect, increases in steps and is divided among several springs so that, upon rapid flexure (pivotal actuation of the pawl), stress on the pawl spring assembly is attenuated and fatique failure obviated.

It is believed now readily apparent that the present invention provides a pawl spring assembly which has a relatively long operative life in a rotary impact mechanism particularly of the type which is power driven. It is an assembly which is easy to assemble and disassemble from a rotary impact mechanism. Furthermore, it is a pawl spring assembly in which the load relative to deflection characteristics remains constant. In addition, as a unitary, single piece structure, it is relatively inexpensive and is easy to insert in a space of very limited dimensions.

Although but one embodiment has been illustrated and described in detail, it is to be understood that the invention is not limited thereto. Various changes can be made in the arrangement of parts without departing from the spirit and scope of the invention as the same will now be understood by those skilled in the art.

What is claimed is:

1. A pawl spring assembly for a rotary impact mechanism for tightening or loosening a fastener of the type comprising an input member, an output member and inertia member arranged in approximate symmetry about a common axis and journaled upon each other at mating, mutually telescoping, circular surfaces for independent angular movement about the common axis, a pawl and ratchet assembly for interconnecting the input and output members together for torque transmission, the pawl being carried by the inertia member and the ratchet connected for conjoined rotation with the output member, a power spring means interconnecting the input and inertia members for storing energy upon relative angular movement of the input and inertia members and for releasing the stored energy to accelerate angular movement of the inertia member, a cam coacting with the pawl upon relative angular movement of the input and inertia members to disengage the pawl from the ratchet and release the pawl for impact engagement with the ratchet to thereby rotatively drive the output member, the pawl spring assembly comprising:

a plurality of spring elements arranged to sequentially engage and load the pawl as the pawl is moved by the cam in a direction to disengage from the ratchet as the pawl is moved by said cam in a direction to disengage from a tooth of the teeth of the output member.

2. The apparatus of claim 1 wherein said spring elements are connected together into a unitary assembly.

3. The apparatus of claim 1 wherein said spring elements are a plurality of spaced substantially parallel leaf springs connected together at opposite adjacent end portions to form a unitary assembly.

4. A pawl spring assembly in combination with a rotary impact mechanism of the type comprising an input member, an output member and inertia member, all approximately symmetrical about a common axis and journaled upon each other at mating, mutually telescoping circular surfaces thereof for independent angular movement about said axis, said output member having a plurality of teeth, a plurality of pawls carried by the inertia member for angular movement therewith, a cam on the input member operative on the pawls as a function of relative angular movement of the input and inertia members in a direction to force the pawls out of engagement with one tooth of said teeth and release such pawl for engagement with another tooth to impact thereagainst and rotatively drive the output member, a power spring means interconnecting the input member and inertia member for storing energy upon relative angular movement of the input and inertia members and for releasing energy to accelerate angular movement of said inertia member, the pawl spring assembly comprising:

a plurality of springs for each pawl disposed relative to the associated pawl so as to sequentially engage and load the associated pawl as the pawl is moved by said cam in a direction out of engagement with a tooth of the teeth of the output member.

5. The apparatus of claim 4 wherein said plurality of springs for each pawl are leaf springs arranged in substantial parallelism and connected together to form a unitary structure.

6. The apparatus of claim 5 wherein said springs are connected together at their opposite adjacent end portions.

* * * * *